United States Patent [19]

Ratner

[11] Patent Number: 4,732,382

[45] Date of Patent: Mar. 22, 1988

[54] TENNIS TRAINING DEVICE

[76] Inventor: Harvey Ratner, 2905 Red Lion La., Silver Spring, Md. 20904

[21] Appl. No.: 694,527

[22] Filed: Jan. 24, 1985

[51] Int. Cl.[4] ..... A63B 61/00

[52] U.S. Cl. ..... 273/29 A; 273/407; 273/29 B; 272/126

[58] Field of Search ..... 273/26 E, 29 A, 319, 273/331, 413, 414, 407, 332, 29 B

[56] References Cited

U.S. PATENT DOCUMENTS

| | | | |
|---|---|---|---|
| 708,569 | 9/1902 | Manley | 273/26 A |
| 824,560 | 6/1906 | Martin | 273/413 |
| 1,959,573 | 5/1934 | Dieball | 273/29 B |
| 2,751,226 | 6/1956 | Conway | 273/26 E |
| 3,105,682 | 10/1963 | Ahrens | 273/413 |
| 3,865,372 | 2/1975 | Moore | 273/414 |
| 4,027,880 | 6/1977 | Hadtke | 273/29 A |
| 4,049,266 | 9/1977 | Feiler | 273/29 A |
| 4,141,550 | 2/1979 | Denizman | 273/29 A |
| 4,160,549 | 7/1969 | Simpson | 273/29 A |
| 4,231,572 | 11/1980 | Thornton | 273/29 A |
| 4,436,304 | 3/1984 | Castleman | 273/29 A |

FOREIGN PATENT DOCUMENTS

| | | | |
|---|---|---|---|
| 2652655 | 5/1978 | Fed. Rep. of Germany | 273/29 A |
| 2039751 | 1/1980 | Fed. Rep. of Germany | 273/26 E |
| 1226016 | 6/1960 | France | 273/331 |

OTHER PUBLICATIONS

Shampaine Industries, Inc., Mar. 10, 1965.

*Primary Examiner*—Richard C. Pinkham
*Assistant Examiner*—T. Brown
*Attorney, Agent, or Firm*—Epstein & Edell

[57] ABSTRACT

A tennis training device includes a rod secured vertically above the tennis court net and having three successive length sections demarked by different colors to guide a tennis player regarding the height of the ball as it passes over the net. The rod is preferably three feet long and each section is one foot in length. Support for the rod is achieved by an extension rod connected end-to-end with the marked rod and inserted through plural interstices of the net. An extension rod may be secured to the top of the marked rod to suspend an apertured target member used for practicing serves. One of the marked/support rods may be provided with two pairs of apertures which cooperate with respective support pins to secure the rod to a chain link fence.

7 Claims, 11 Drawing Figures

TENNIS TRAINING DEVICE

BACKGROUND OF THE INVENTION

1. Technical Field

The present invention relates to tennis training devices and, more particularly, to a device which permits a tennis player to practice a variety of skills as well as strategies.

2. Discussion of the Prior Art

Substantially all tennis training devices of which I am aware are designed for practicing a single skill, whether that skill be serving, ground stroking, backhand stroking, etc. It is important, however, that all of the skills required in the game of tennis be practiced and, more importantly, be understood. Apart from the skills required and strategy involved in playing tennis, it is important that players properly exercise and warm up before beginning play in order to avoid injury. Few, if any, tennis training devices are concerned with exercise and warm-up.

I have found in my experience as a tennis instructor that most tennis players have difficulty not only learning the proper technique of correct strokes, but also are totally unaware of the various heights, angles and stroke velocities required to keep the ball in play and to keep the opponent on the defensive. There is, therefore, a definite need for a tennis training device which identifies these heights, angles and velocities in a way that can be easily recognized and employed by tennis players of all skill levels.

My experience as a tennis instructor has also shown me the need for a device which permits tennis players to learn the proper rhythmic service motion as well as the ball toss required for serving.

OBJECTS AND SUMMARY OF THE INVENTION

It is, therefore, an object of the present invention to provide a tennis training device which is simple and inexpensive yet can be used by the tennis player to exercise and warm-up, to learn the various heights, angles and velocities required for forehand and backhand strokes, and to learn the rhythmic motion and ball toss required for serving.

Accordingly, the invention includes a marked rod, preferably three feet in length, having three longitudinal sections of different colors. The marked rod is secured vertically at the net such that the lowermost red section extends from the net to one foot above the net, the intermediate yellow section extends from the red section to two feet above the net, and the uppermost green section extends from the yellow section to three feet above the net. The three colored sections of the marked rod provide the means for allowing a player to retain both a physical and mental picture of the desired height for the ball in passing over the net. More specifically, the height of the ball when passing over the net is directly related to the depth of the shot in the receiving player's court. I have found that as a player learns to hit the ball "through" different colors (i.e., at heights corresponding to the different colors), he or she can correlate the color to the shot depth. Since it is desirable to keep the opponent as deep in his/her own court as possible, this correlation vastly improves the quality of a player's game. The same correlation feature applies to the receiving player who is able to adjust his/her depth position to properly return the ball as a function of the color/height of approaching shot as it passes over the net. In essence, then, the rod becomes a height gauge or target to which the player may relate in both stroking the ball and positioning himself/herself for a return.

In the preferred embodiment the marked rod is supported above the net by a support rod secured thereto in end-to end relation by a compression coupling member. The support rod may be removably woven through the interstices of the net so that the two tubes are supported vertically by the net itself.

Either the marked rod, the support rod, or the two joined rods may be used as a bending and stretching exercise and warm-up aid to exercise the muscles involved in playing tennis. Specifically, the rod is placed across the player's shoulders, behind the neck, and the player's arms are wrapped over respective extending portions of the rod. In this position, the player may bend forward or to either side from the waist, or may twist the upper torso in either direction.

The marked rod preferably has a tennis ball tethered to its upper end. The rhythmic movement required for serving may be practiced by holding the bottom end of the marked rod and swinging the rod in a "figure-eight" serving motion while maintaining the tether taut and the ball in motion.

The support rod is preferably provided with two pairs of holes, each of which receives a respective support pin, for securing the assembled rods to a chain link fence such that the tethered ball is suspended at a desired height to be struck for practicing serving.

BRIEF DESCRIPTION OF THE DRAWINGS

These and other objects, features and many of the advantages of the invention will be better understood upon a reading of the following detailed description considered in conjunction with the accompanying drawings wherein like parts in each of the several figures are identified by the same reference numerals, and wherein.

DESCRIPTION OF THE PREFERRED EMBODIMENTS

Figure 1:
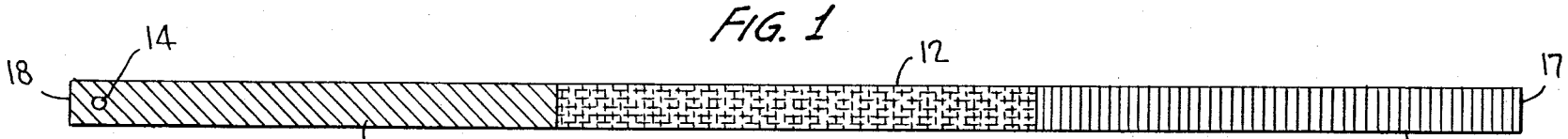
FIG. 1 is a top view in plan of a marked rod comprising part of the tennis training device of the present invention.
Figure 2:
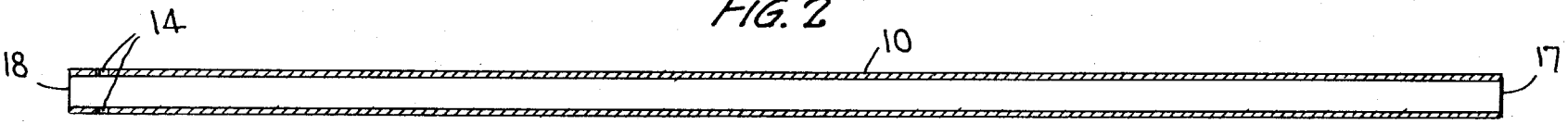
FIG. 2 is a view in longitudinal section of the rod of FIG. 1.

Referring specifically to FIGS. 1 and 2, a marked rod 10, comprising an essential component of the present invention, is illustrated in the form of a hollow tube. Although rod 10 is illustrated as being a cylindrical hollow tube, it is to be understood that the rod is not required to be either cylindrical or hollow to serve its intended function for the present invention. In the preferred embodiment, however, rod 10 is a rigid cylindrical tube made of suitable plastic, metal or wood, three feet long, one and one-half inches in outside diameter and having a wall thickness of one-quarter inch. The outer surface of marked rod 10 is subdivided into three successively adjacent sections 11, 12 and 13 demarked by respective colors. The lowermost section 11 is preferably colored red, intermediate section 12 is preferably colored yellow, and uppermost section 13 is preferably colored green. A pair of through holes 14 are defined in diametric alignment through upper section 13 at a location approximately one inch from the upper end of the rod. Holes 14 are approximately one-quarter inch in diameter and serve to receive a tether 15 (see FIG. 7) for a tennis ball 16 tethered to rod 10. The colored sections may be defined by painting the outside of the rod, forming the rod with different colored sections, or any other suitable technique. In my preferred embodiment the sections are demarked by colored vinyl sheets secured circumferentially about the corresponding rod sections by means of adhesive.

Figure 3:
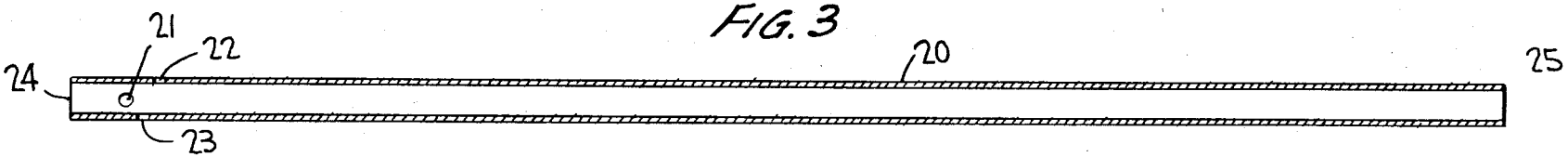
FIG. 3 is a view in longitudinal section of a support used to mount the marked rod of FIG. 1 above a tennis court net.

A support rod 20, illustrated in FIG. 3, is used to secure the marked rod 10 to a tennis court net. Support rod 20 is preferably identical in length, shape and diameter to the marked rod 10 but requires no subdivisional marking on its outer surface. A first pair of diametrically opposed through holes 21 (only one hole is visible in FIG. 3) are defined through support rod 20 at a location approximately one and one-half inches from the upper end of the rod. A third hole 22 is defined through the tube wall at a location approximately two inches from the upper end of rod 20 and spaced circumferentially from each of holes 21 by an angle of approximately ninety degrees. A fourth hole 23 is defined through the wall of rod 20 at a location approximately one and three-quarters inches from the top of rod 20 and spaced circumferentially from hole 22 by an angle of 180°.

Figure 4:
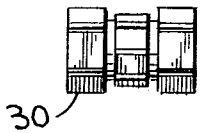
FIG. 4 is a top view in plan of a compression coupling member employed to join the rods of FIGS. 1 and 3 in end-to-end relation.
Figure 9:
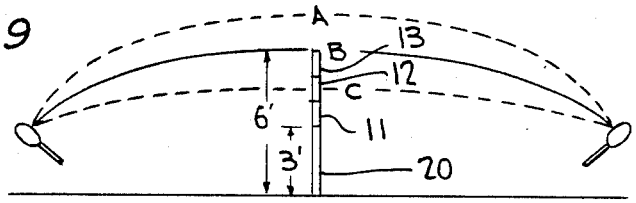
FIG. 9 is a diagrammatic illustration similar to that of FIG. 8 but showing tennis shots of different trajectories.
Figure 8:
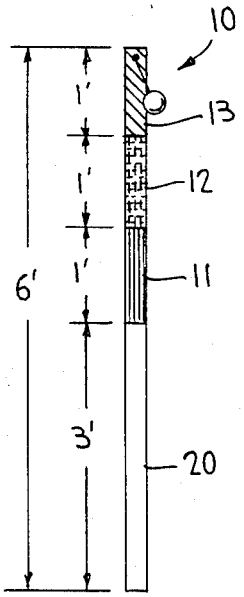
FIG. 8 is a diagrammatic illustration of the assembled rods showing the various heights and related colors above a tennis court net.
Figure 10:
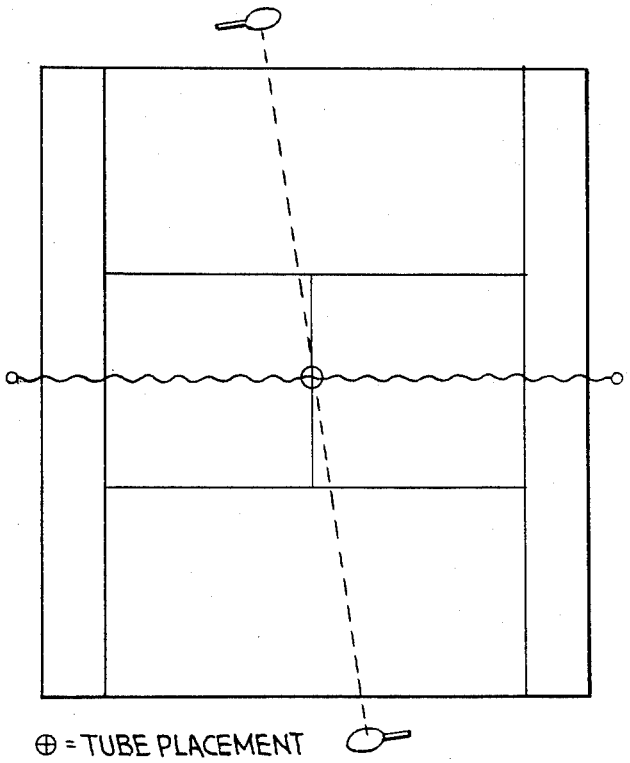
FIG. 10 is a diagram of a tennis court showing one possible placement of the tubes of FIGS. 1 and 3.

The lower end 17 of marked rod 10 and the upper end 24 of support rod 20 are received in respective sockets of a compression coupling member 30 illustrated in FIG. 4. Member 30 is a standard commercially available coupling member employed to assemble rods 10 and 20 in axial alignment and substantially end-to-end relation. When so joined, the support rod 20 may be weaved vertically downward through interstices of a tennis court net until the lower end 25 of rod 20 rests on the ground. The net thus supports rod 20 in vertical orientation with marked rod 10 extending vertically above the net. Since rod 20 is approximately equal in length to the height of the tennis court net, substantially only the marked rod 10 extends above the net with the three sections 11, 12 and 13 clearly visible above the net. This orientation of the rods is diagrammatically illustrated in FIGS. 8 and 9. The assembly may be secured to the net at any location across the court, such as the centered location illustrated in FIG. 10, end location near or in the doubles lanes, or any location in between. When thus secured to the net, the assembly, particularly the subdivided marked rod 10, serves as a height target at the net which can be related to the depth of a shot by both the stroking player and the receiving player.

The stroking player uses the colored height targets to achieve desired court depth with his or her strokes. Such player is instructed to always hit the ball such that it is passes over the net at a height within the green range defined by section 13 or the top half of the yellow range of section 12. The player will learn (some more rapidly than others) how to vary shot velocity to achieve the desired depth of his or her shots. Shots which pass over the net at the height of red section 11 or the lower portion on yellow section 12 will always fall at a very shallow location (i.e., proximate the service line) and are more easily controlled by the receiving player. As a player becomes more proficient in hitting the ball over the net at a height corresponding to the green section of rod 10, his/her shots will land deeper in the court with greater ease and accuracy.

The receiving player, on the other hand, by correlating the approaching shot height to the colored sections on rod 10, will be able to more easily position himself/herself properly to return the shot. For example, with reference to FIG. 9, if a ball is hit with a trajectory such as that designated by the letter B (i.e., through green section 13), the player should stay proximate the base line because the shot will fall relatively deep in the court. If an approaching shot having trajectory C (i.e., passing through yellow section 12) is observed, the receiving player must move forward to be properly positioned to return the ball. If the ball is even lower as it passes over the net, the receiving player must move more quickly to the net and will likely be in a position to hit a controlling shot. If a ball having a trajectory which passes over the net at a height above rod 10 (i.e., trajectory A), the receiving player must move back beyond the base line. After practicing with the invention, players tend to think "green", or "red", or "yellow" and move automatically to the proper court location dictated by the color.

Figure 7:
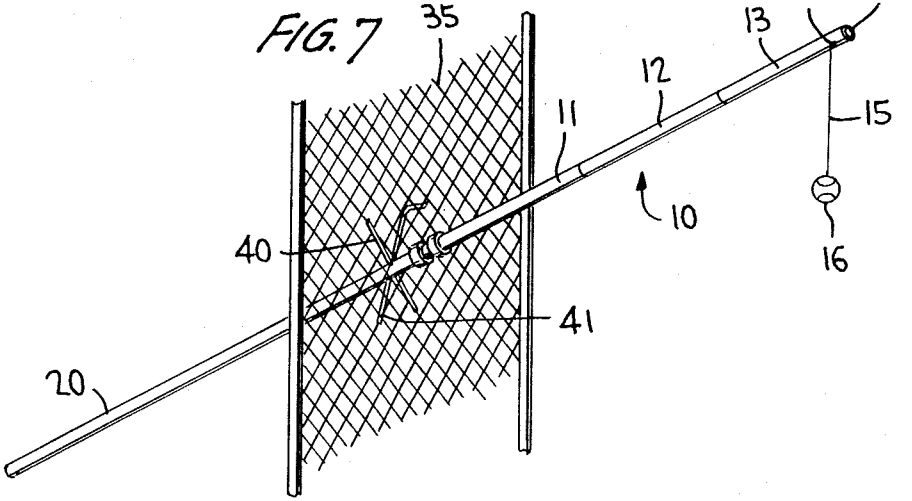
FIG. 7 is a view in perspective showing the support rod of FIG. 3 secured to a chain link fence by means of the support pins of FIGS. 5 and 6 such that a tennis ball tethered from the assembled marked rod may be suspended at a desired height to practice serving.
Figure 5:
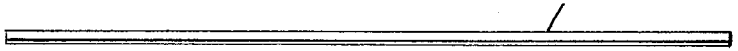
FIG. 5 is a top view in plan of a first support pin employed to secure the rod of FIG. 3 to a chain link fence.
Figure 6:
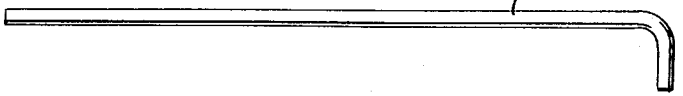
FIG. 6 is a top view in plan of a second support pin employed to secure the rod of FIG. 3 to a chain link fence.

In order to practice serving, the assembled rods 10 and 20 are secured to a conventional chain link fence 35 in the manner illustrated in FIG. 7. Such chain link fences are found surrounding many tennis courts and have interstices which permit insertion of rod 20 through the fence. Specifically, the assembled rods are inserted through the fence until mounting holes 21 are on the opposite side of the fence from mounting holes 22 and 23. Support pin or rod 40 is then inserted through mounting holes 21 and support pin or rod 41 is inserted through mounting holes 22, 23. Support pin 40, illustrated in detail in FIG. 5, is a metal rod, five sixteenths inch in diameter and approximately ten inches long. This pin, as illustrated in FIG. 7, is sized to fit through mounting holes 21, perpendicular to rod 20, such the exposed ends of the pin rest against the front side of fence 35. Support pin 41, illustrated in detail in FIG. 6, is a metal rod five-sixteenths inch in diameter, ten inches long, with one inch at one end bent at right angles to the major lengthwise portion of the pin. This pin, as illustrated in FIG. 7, passes through mounting holes 22, 23 at an angle to rod 20 such that the pin resides primarily on the opposite or rear side of fence 35 with the bent end of the pin projecting through the fence. Pins 40 and 41 cooperate, therefore, from opposite sides of the fence to fix rod 20 longitudinally relative to the fence. The bent end of pin 41 prevents the rod assembly from rotating about its longitudinal axis.

With the rod assembly secured to the fence in the manner shown in FIG. 7, the upper end 18 of marked rod 10 is disposed above the player's head and the tethered ball 16 is suspended at a height suitable for practicing serving strokes. In this regard, the height of tethered ball 16 may be adjusted by adjusting the height at which the rod assembly passes through fence 35 or by knotting tether 15 to vary its length.

Figure 11:
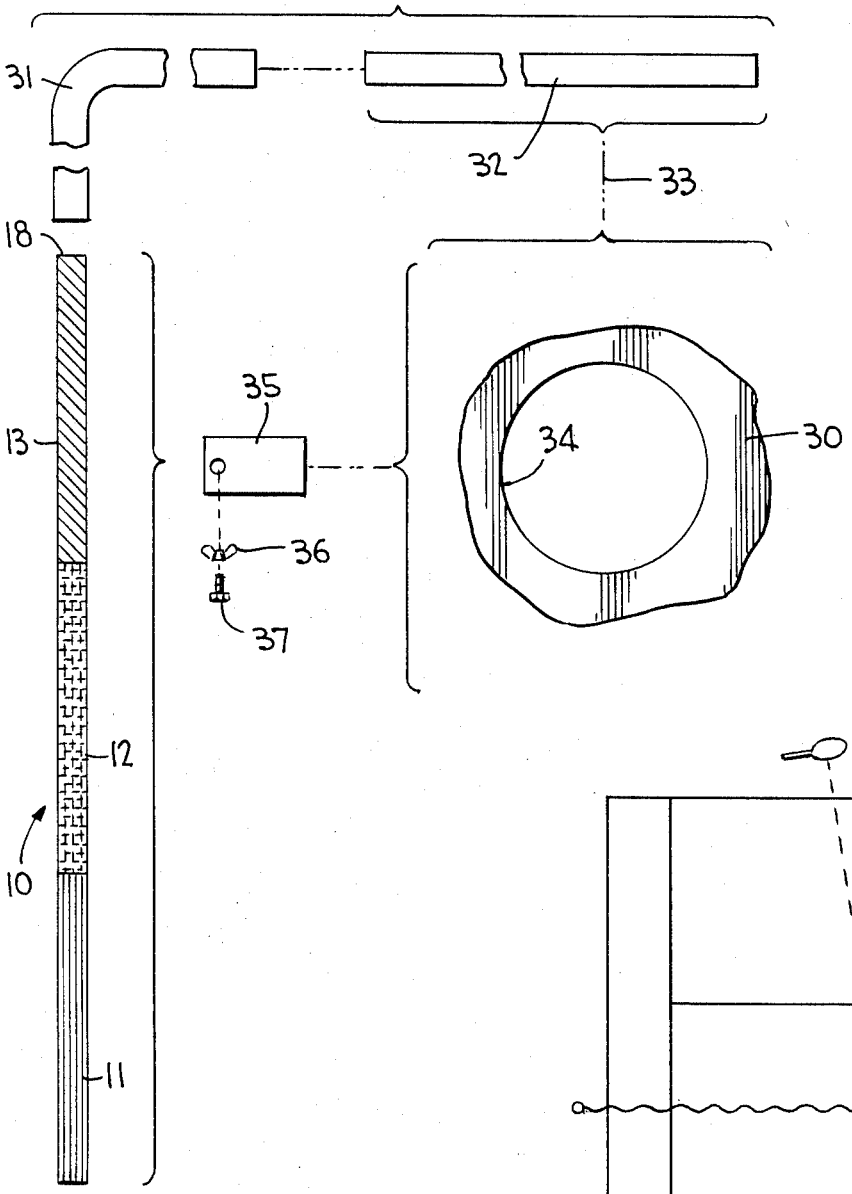
FIG. 11 is a front view in elevation of the marked rod of FIG. 1 used in conjunction with an apertured target.

Further serving practice may be achieved by the use of an apertured target 30 secured to the marked rod 10. Specifically, with reference to FIG. 11, an elbow coupling 31 may be secured to the upper end 18 of rod 10 so that an extension rod 32 may be secured to the coupling and extend horizontally from the top of rod 10. At its distal end the extension rod may be provided with suitable holes for a string or rope 33 to pass through. String 33 suspends an apertured target 30 member from the distal end of the extension rod, the apertured target being made of plastic, or the like, and having a circular target aperture 34 approximately eighteen inches in diameter. In order to avoid rotation of the apertured target 30 and to assure that the aperture faces the server, a portion of the target may be provided with a flange 35 that can be secured to marked rod 10 (for example, at section 12) by means of a wing-nut 36 and screw 37 passing through suitably provided holes in the marked rod and apertured target.

I have described an improved tennis training device which facilitates preliminary warm-up and exercise, permits understanding of various heights, angles and velocities involved in proper tennis strokes, and serves as an aid to improve a player's serve. The device is simple to use, inexpensive to produce and extremely versatile.

The present invention includes all of the novel features residing in the description and drawings. It will be obvious to those skilled in the art that various minor changes can be made without departing from the concept of the invention, and all such changes are intended to fall within the scope of the appended claims.

I claim:

1. A tennis training apparatus comprising:

a standard tennis net of the type having interwoven members and multiple interstices between said interwoven members, said net being tautly supported at its ends to extend across a playing area;

an elongated rod having first and second ends, said rod being inserted through plural vertically aligned interstices of said net with said first end abutting the ground to support the rod by means of the net and the ground in a vertical orientation, said rod having an upper length portion extending entirely above said net and terminating at said second end;

wherein said upper length portion is subdivided into a plurality of successive length segments, each length segment having a different color.

2. The tennis training apparatus according to claim 1 wherein said upper length portion is approximately three feet long, and wherein said plurality of length segments are three in number, each length segment being approximately one foot long.

3. The tennis training apparatus according to claim 1 wherein said rod has two separable length sections, a first section corresponding to said upper length portion, and a second section serving as a support portion, said apparatus further comprising coupling means for securing said first and second sections together in end-to-end orientation.

4. The tennis training apparatus according to claim 1 further comprising:

an extension rod having first and second ends;

means securing said first end of said extension rod to said second end of said elongated rod such that the extension rod extends radially outward and away from said elongated rod;

a target member having an aperture defined therein which is larger than a standard tennis ball; and means suspending said target member from said first end of said extension rod.

5. The tennis training apparatus according to claim 4 further comprising means for selectively adjusting the height at which said apertured member is suspended from said first end of said extension rod.

6. The tennis training apparatus according to claim 4 further comprising means securing said target member to said elongated rod for preventing rotation of said target member about a vertical axis and thereby assuring that the target member faces a specified direction.

7. The tennis training apparatus according to claim 1 wherein said elongated rod is selectively removable from said net and repositionable at multiple positions along said net by interweaving the elongated rod through other vertically aligned interstices of said net so as to rest said first end of said elongated rod on the ground.

* * * * *